US006746052B1

(12) United States Patent
Reynolds

(10) Patent No.: US 6,746,052 B1
(45) Date of Patent: Jun. 8, 2004

(54) INFORMATION STORAGE DEVICE

(75) Inventor: Henry Reynolds, 4 Glamis Drive, Southport, Merseyside PR9 8PL (GB)

(73) Assignee: Henry Reynolds, Southport (GB)

( * ) Notice: Subject to any disclaimer, the term of this patent is extended or adjusted under 35 U.S.C. 154(b) by 0 days.

(21) Appl. No.: 09/762,313

(22) PCT Filed: Aug. 6, 1999

(86) PCT No.: PCT/GB99/02350

§ 371 (c)(1),
(2), (4) Date: Apr. 2, 2001

(87) PCT Pub. No.: WO00/07827

PCT Pub. Date: Feb. 17, 2000

(30) Foreign Application Priority Data

| | | |
|---|---|---|
| Aug. 6, 1998 | (GB) | 9817020 |
| Nov. 6, 1998 | (GB) | 9824261 |
| Apr. 12, 1999 | (GB) | 9908131 |
| May 19, 1999 | (GB) | 9911497 |

(51) Int. Cl.[7] ..... B42D 15/00

(52) U.S. Cl. ..... 283/61; 283/62; 283/34; 283/63.1; 281/2; 281/5; 462/64

(58) Field of Search ..... 281/2, 5, 38, 51; 283/61, 62, 34, 35, 63.1; 462/64

(56) References Cited

U.S. PATENT DOCUMENTS

| | | | | |
|---|---|---|---|---|
| 4,586,729 A | * | 5/1986 | Beylerian | 281/2 |
| 4,606,553 A | * | 8/1986 | Nickerson | 283/34 |
| 5,358,761 A | * | 10/1994 | McDonald | 283/34 |
| 6,209,919 B1 | * | 4/2001 | Nilsson et al. | 283/61 |

* cited by examiner

*Primary Examiner*—Willmon Fridie, Jr.
(74) *Attorney, Agent, or Firm*—Henry Reynolds

(57) ABSTRACT

An information storage device having a first part such as an insert on which information is provided and a second part comprising a holder for the first part, whereby the first part may be stored in the second part. The edges of the first and second parts may be provided with lips for mating together to provide interlocking parts whereby the first part may be pulled outwardly to expose the information thereon but is prevented from being completely separated from the holder.

7 Claims, 10 Drawing Sheets

Figure 1A:
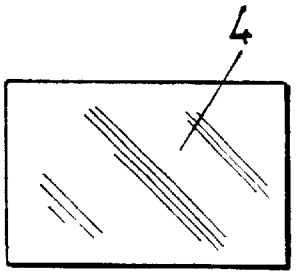
Figure 1D:
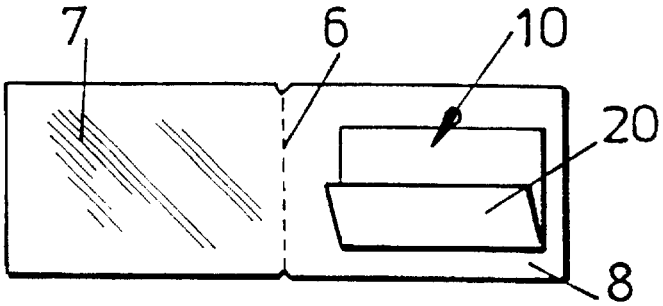

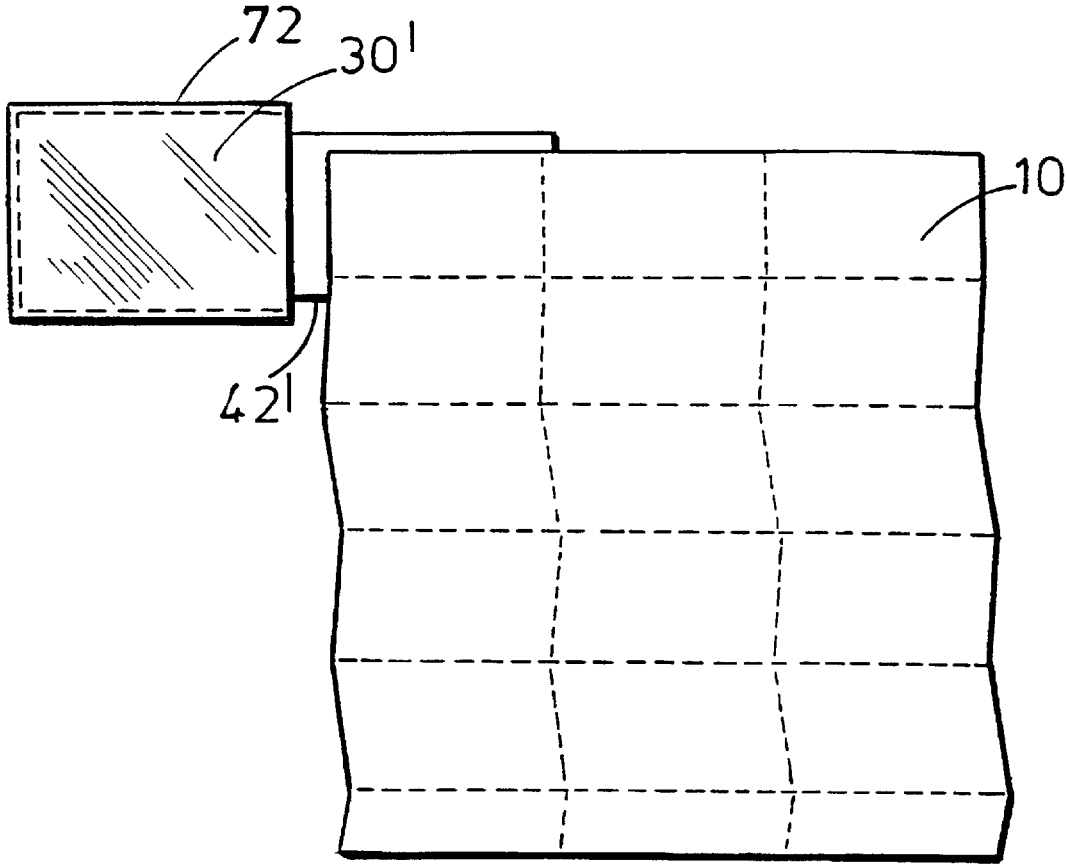
FIG. 3d
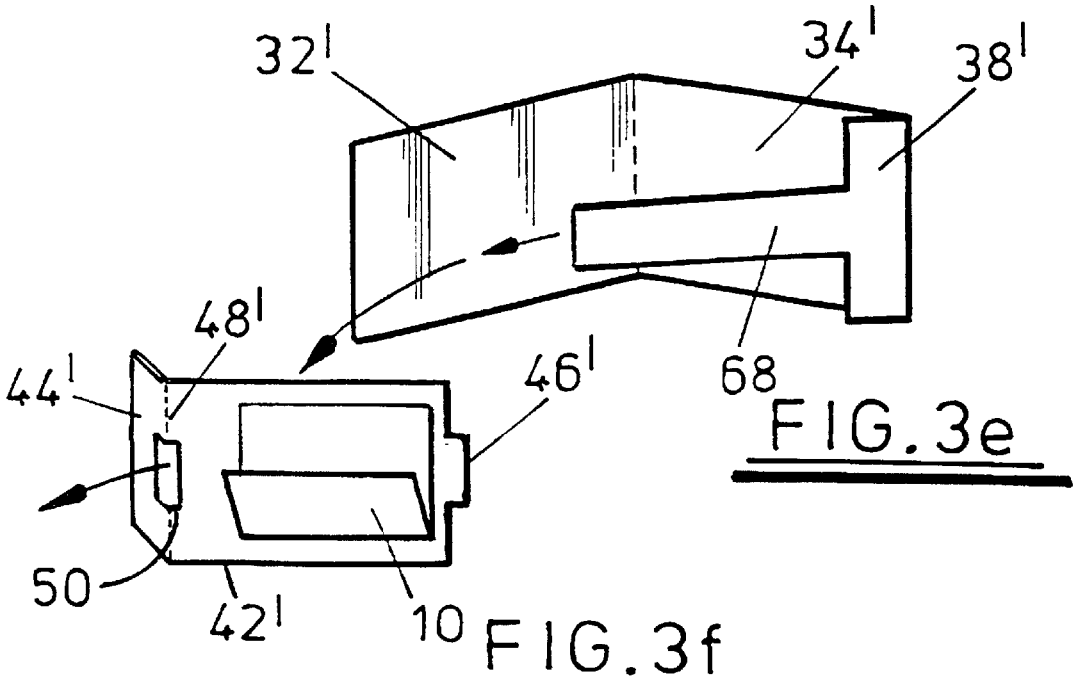
FIG. 3e
FIG. 3f

300

304
302
306

312
308
310
314

316
316c
316a
316b 318
322

320
318

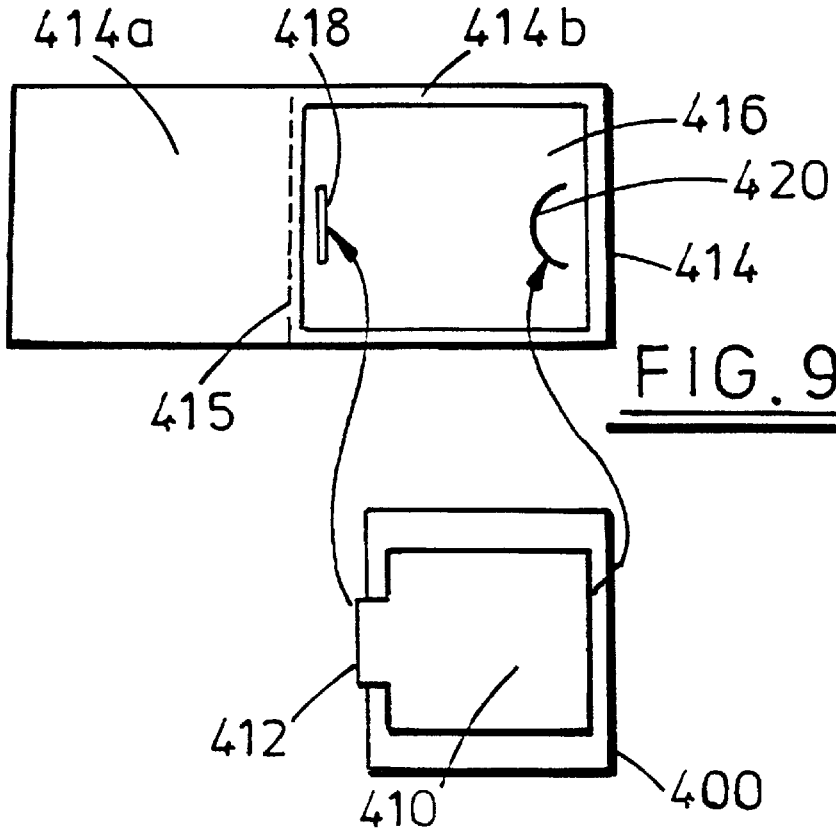
FIG. 9a
FIG. 9b
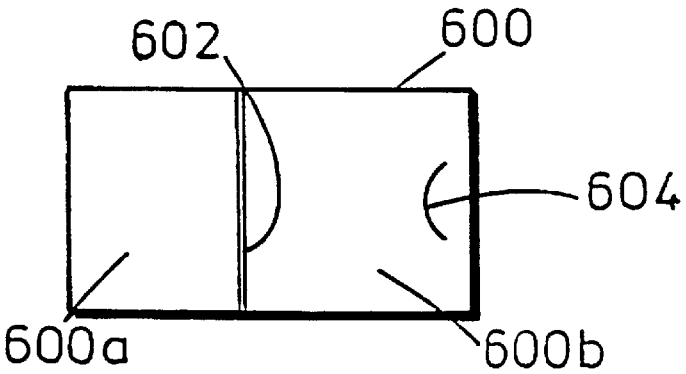
FIG. 10a
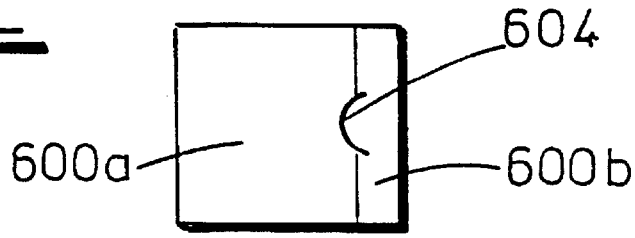
FIG. 10b

INFORMATION STORAGE DEVICE

The present invention relates to an improved information storage device, particularly but not exclusively for containing information for storage in a pocket, wallet or the like.

It is often beneficial to have information supplied on cards or folded sheets which can be carried in a handbag, wallet or pocket of the user such that the information is readily to hand, for example in the form of business cards, maps, timetables and the like.

It is an object of the present invention to provide an improved information storage device for containing information for storage in a wallet, pocket or the like.

Accordingly, the present invention provides an information storage device comprising a first part on which information is provided and a second part comprising a holder for the first part, whereby the first part may be stored in the second part.

The first part may be a single sheet bearing information on one or both sides. Preferably, the first part is in the form of a folded sheet provided by a sheet having a plurality of tranverse and longitudinal fold lines whereby the sheet may be folded and unfolded between a compact and expanded state. The folded sheet is dimnensioned to fit within the second part in the compact state.

Alternatively, the first part may be in the form of an insert which is slidable into and out of the second part. Information may be displayed on the insert or, more preferably, a folded sheet is adhered to the insert having information displayed thereon.

The insert is preferably in the form of a generally rectangular section, being of the same, or slightly smaller, size as the second part of the device. Preferably, an edge of the insert is provided with a tab to assist in removal of the insert from said second part. The provision of an insert for attachment of the folded sheet allows the insert to be quickly and easily replaced with a different insert, such as one having a sheet displaying alternative information thereon.

Alternatively or additionally, the folded sheet may be detachable from the insert or second part. The sheet may be provided with means for allowing temporary engagement with a part of the insert or second part of the device. For example, the folded sheet containing the required information may be adhered to a front section of a folded piece of card. The rear of the folded card may then be inserted into a wallet which is adhered to an insert. The wallet preferably comprises two pieces of plastics material which are sealed around all sides except one to allow insertion of the rear section of the folded card. Preferably, the intended top or outer side of the wallet is provided with the opening for insertion of the folded card. Alternatively, the sheet may be adhered to a rectangular piece of material having a tab extending from one edge thereof. A part of the insert or cover may be provided with a slot therethrough and a die-cut pocket forming a tab. In this manner the tab of the material having the sheet attached thereto may be inserted through the slot and the leading edge of the material may be retained behind the tab formed by the die-cut pocket. Alternatively, the tab may be provided on the insert or cover for insertion in a slot provided through the material carrying the folded sheet. Similarly, the insert may be detachable from the cover by means of the same mechanism.

The second part of the information storage device is preferably in the form of a cover having a front section and a rear section to provide a sleeve or pocket for receiving said first part. Preferably, the cover is generally rectangular in plan view, being provided with a fold line through the centre thereof to define the front section and the rear section. The cover may be provided with means for securing the front section to the rear section, for example the rear section may be provided with a die-cut pocket for forming a tab whereby the leading edge of the front section may be retained. The sheet may be adhered to the inner side of the rear section, for example by an adhesive placed over a corner section of the sheet, preferably the top left hand corner section.

Ideally, the cover is provided with a retaining lip along at least one edge thereof for mating with a lip provided on an edge of the first part, preferably being provided on the insert. It is preferable to provide the lip on the leading edge of the front or rear section being folded inwardly to mate with a lip provided on the edge of the insert opposite the tab thereby providing an interlocking insert and cover. The lips serve to resist the insert from being pulled free of the cover. Alternatively, two retaining lips may be provided on opposite edges of the front or rear section of the cover. The lips may extend along the length of the sides of the section or, more preferably, extend along only a part thereof. Preferably, the lips are provided at the free end of the rear or front section. Alternatively, a strip may extend across from opposite sides of the front or rear section to act as a retaining lip.

The lip of the cover may be provided with an extension, for example in the form of a strip which, in the assembled state, extends inwardly towards the centre fold line of the cover. The fold line between the lip and rectangular section of the insert may be provided with a slot for passage of the strip. This allows the insert to be pulled outwardly from the cover to expose the folded sheet but prevents the insert from being completely separated from the cover. Alternatively, the strip could extend from the fold line of the cover, being provided with a tab at the free end thereof to retain the insert on the slot but allowing a degree of movement along the strip to enable exposure of the folded sheet.

In an alternative embodiment, a separate retaining strap may be provided for slidably mounting the first part with respect to said second part. For example, the strap may be comprised of three sections, a narrow section, a middle wider section and a flange. The flange retains the strap on the insert and the narrow section may be inserted through a slot provided in the cover, the end of the narrow section being bent over to prevent the strap becoming free of the components.

Ideally, a case is provided to receive said first and second parts of the information storage device, for example being made of a plastics material. Preferably, the second part remains in the case and the information is displayed by pulling the insert by means of the tab. Preferably, the interlocking lips and/or strip and slot of the cover and insert prevent the insert from being completely removed from the case. This allows the first part carrying the information to be easily placed back inside the second part and case for storage purposes.

The first and/or second part may also be provided with one or more flaps along a side thereof for attachment of an additional folded sheet.

It is to be appreciated that the folded sheet should be made of a lightweight paper which may be contained within the second part and/or case but which retains fold lines therein for repeated folding and unfolding thereof. The insert and cover may be made of a cardboard which, although rigid has a degree of flexibility or any other suitable material, such as polypropylene or polyvinylchloride.

The cover, insert and/or case may be supplied without the folded sheet, the insert or case being provided with a double-sided adhesive or other means for attachment of a folded sheet containing the required information. The insert may also be supplied with a folded sheet for replacement of an insert.

Figure 2A:
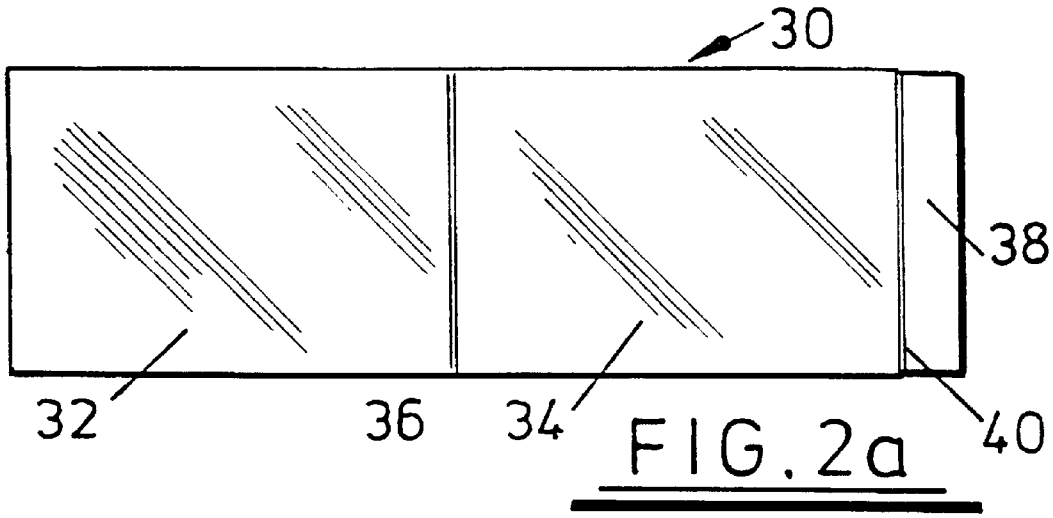
Figure 2B:
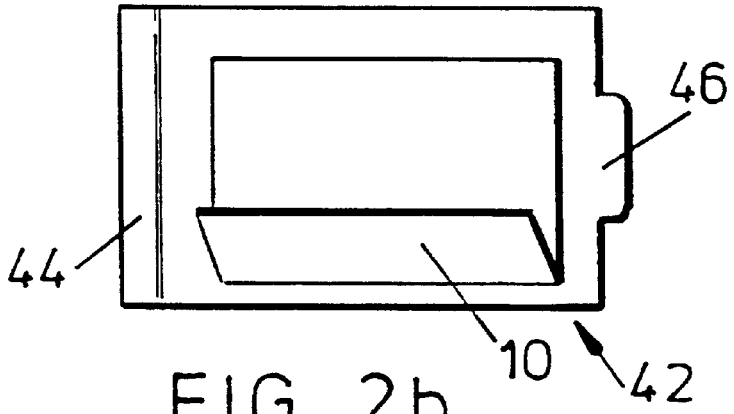
Figure 2C:
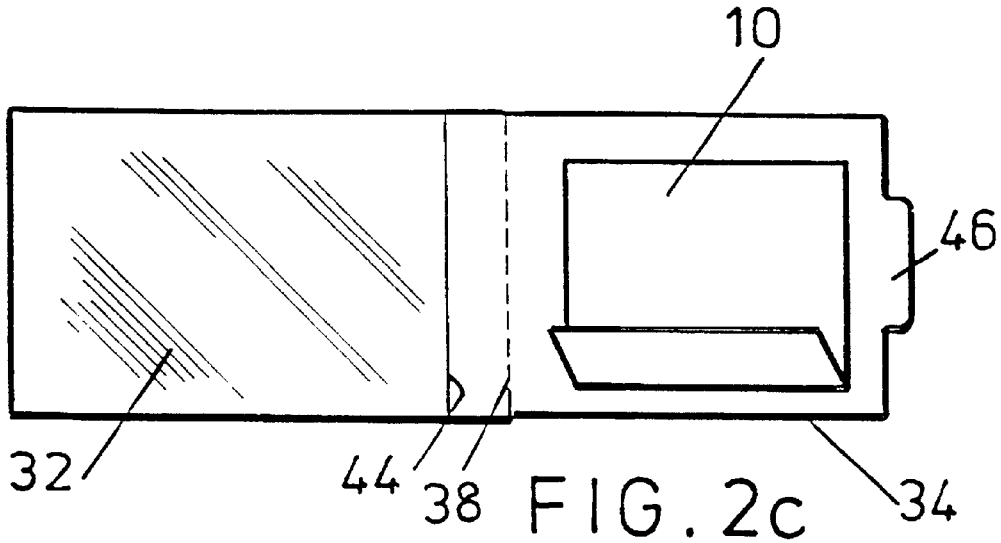
Figure 2D:
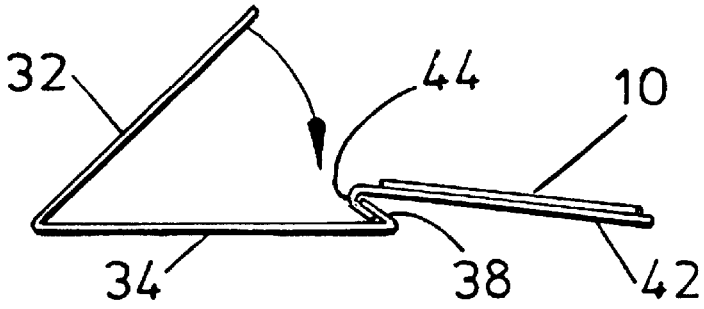

For a better understanding of the present invention and to show more clearly how it may be carried into effect, reference will now be made by way of example only, to the accompanying drawings in which:

FIGS. 1*a* to 1*d* are schematic diagrams of an information storage device according to a first embodiment of the present invention;

FIG. 2*a* is a top plan view of a second part of the information storage device according to second embodiment of the present invention;

FIG. 2*b* is a top plan view of a first part of the storage device shown in FIG. 2*a*, having a folded sheet attached thereto;

FIG. 2*c* is a top plan view of the components shown in FIG. 2*a* and 2*b* assembled together;

FIG. 2*d* is a cross-sectional view of the components shown in FIG. 2*c;*

Figure 3A:
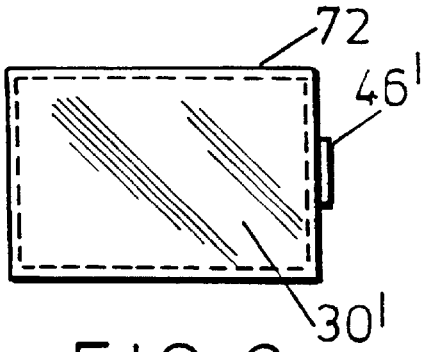
Figure 3B:
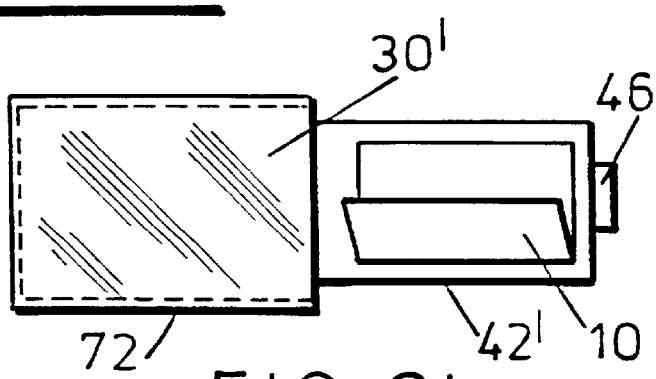
Figure 3C:
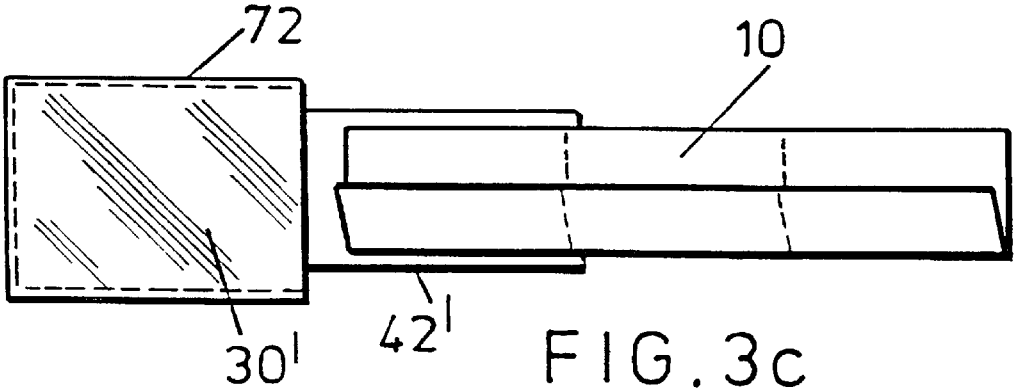

FIGS. 3*a* to 3*d* are top plan views of an information storage device according to a third embodiment of the present invention;

FIGS. 3*e* and 3*f* are schematic perspective views of the device shown in FIGS. 3*a* to 3*d;*

Figure 3G:
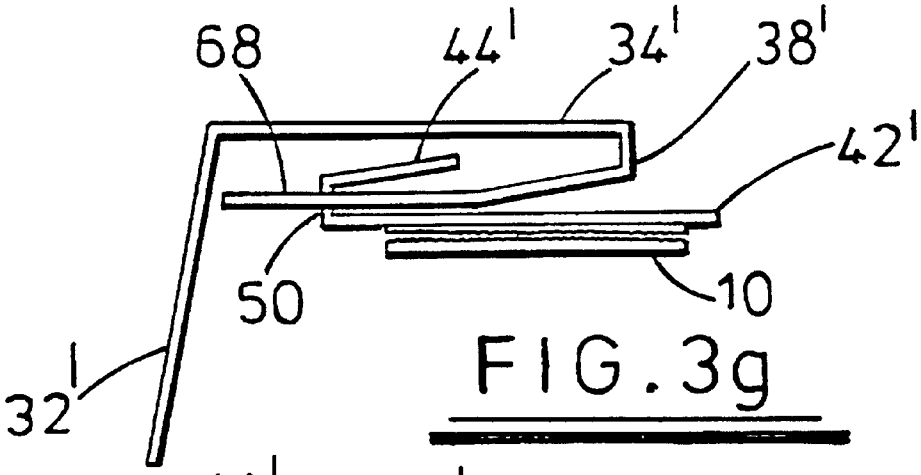
Figure 3H:
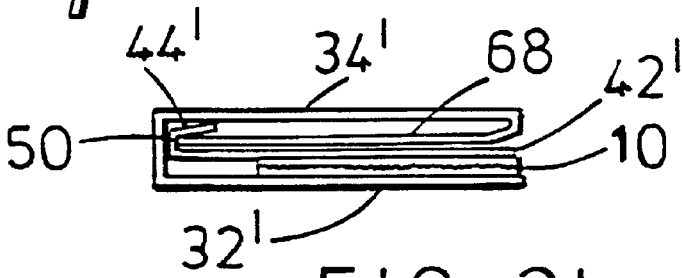

FIGS. 3*g* and 3*h* are schematic cross-sectional views of the device shown in FIGS. 3*e* and 3*f;*

Figure 4:
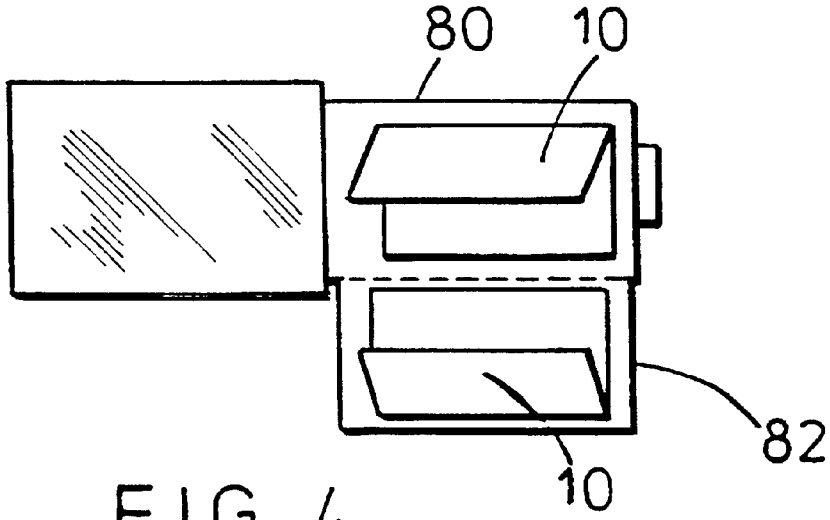
Figures 5A, 5B, 5C, 5D:
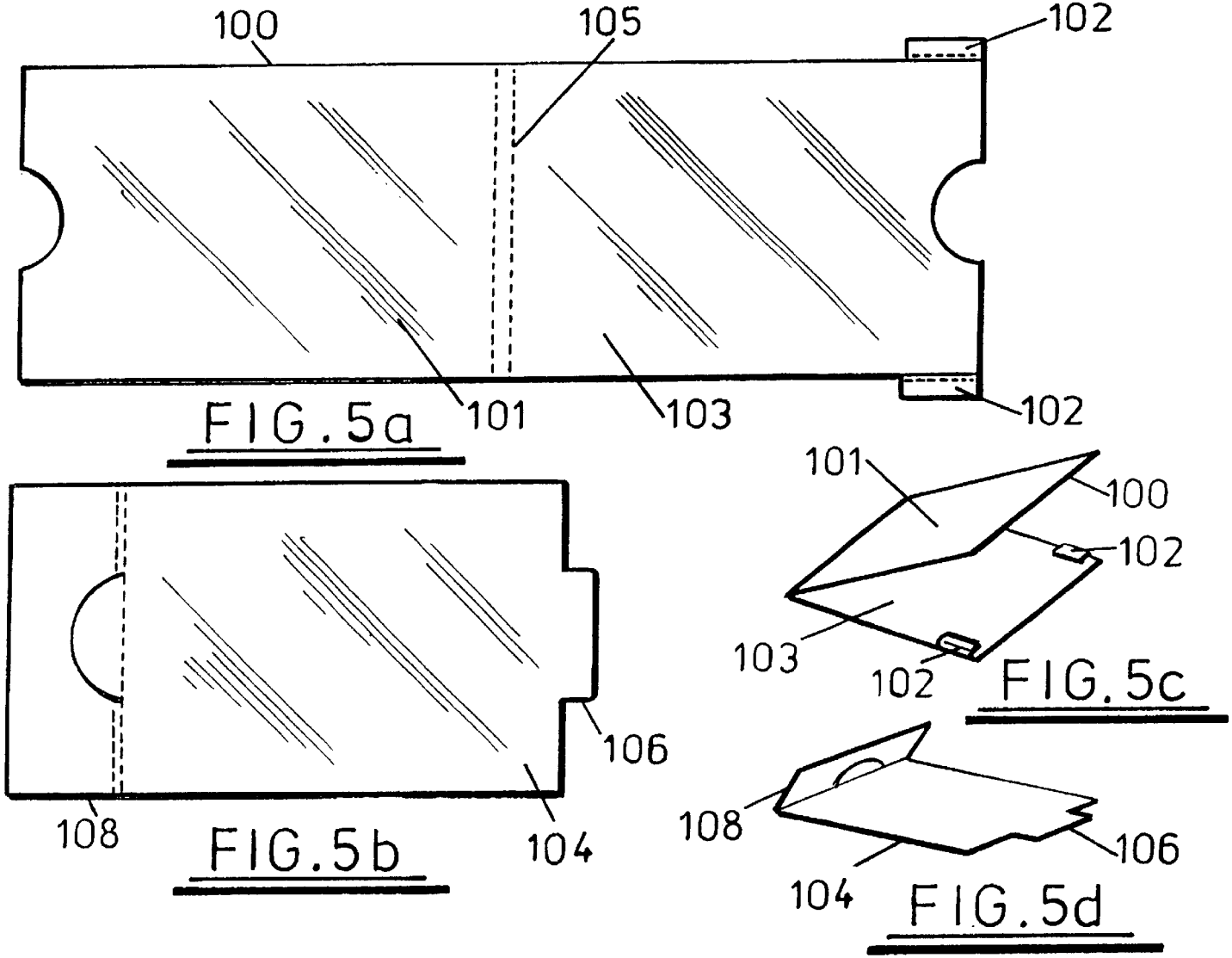
Figure 6:
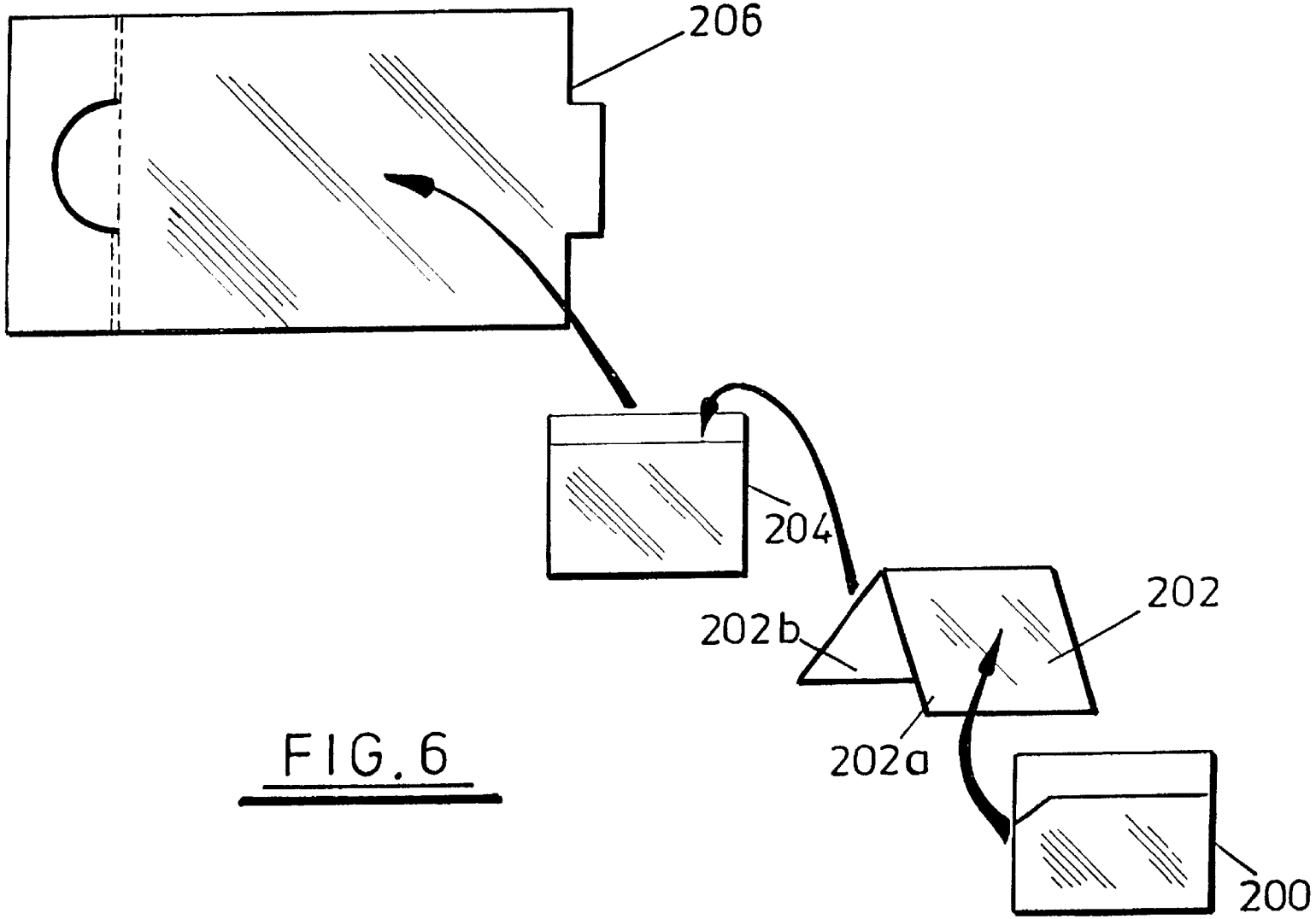
Figure 7A:
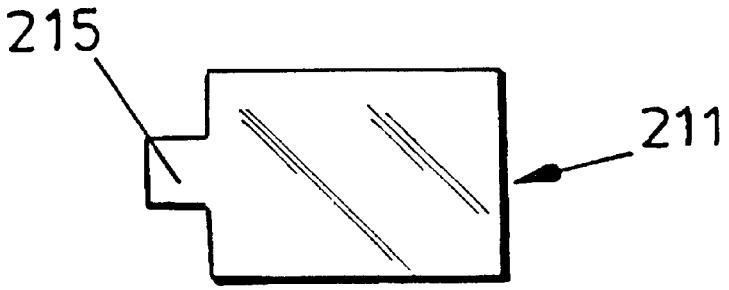
Figure 7B:
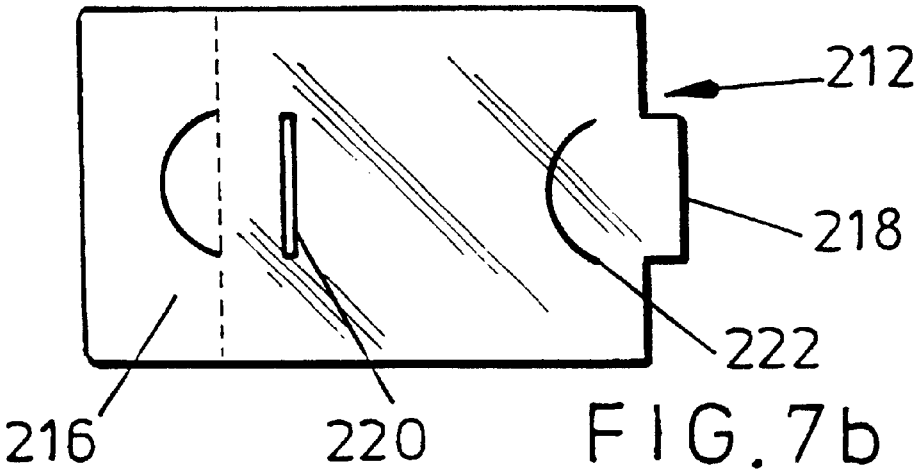
Figure 7C:
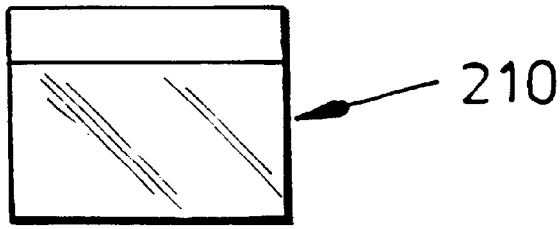
Figures 8A, 8B, 8C, 8D, 8E:
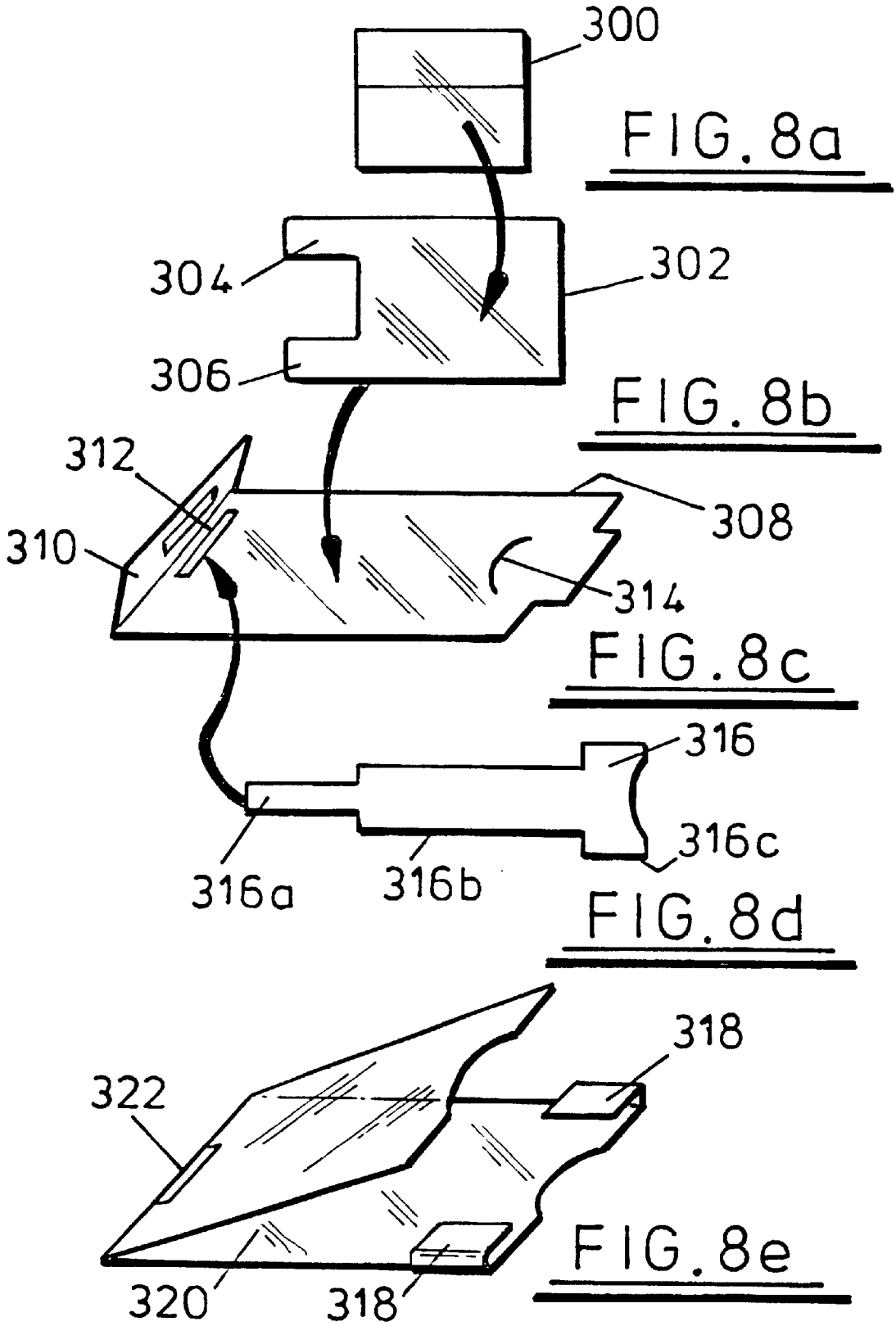

FIG. 4 is a schematic diagram of an information storage device according to a fourth embodiment of the present invention;

FIGS. 5*a* to 5*d* are schematic diagrams of a fifth embodiment of the present invention, FIG. 6 is schematic diagram of the components of a sixth embodiment of the present invention;

FIGS. 7*a* to 7*c* are schematic diagrams of the components of a first part of an information storage device according to a seventh embodiment of the present invention;

FIGS. 8*a* to 8*e* are schematic diagrams of the components of an information storage device according to an eighth embodiment of the present invention;

FIGS. 9*a* and 9*b* are schematic diagrams of the components of an information storage device according to a ninth embodiment of the present invention; and FIGS. 10*a* and 10*b* are schematic diagrams of a second part of an information storage device according to a tenth embodiment of the present invention.

FIGS. 1*a* to 1*d* of the accompanying drawings illustrate one embodiment of an information storage device according to the present invention. The device has a second part in the form of a cover 4 comprised of a rectangular sheet which is provided with a fold line 6 through the centre thereof to define a front section 7 and a rear section 8. The rear section has a folded sheet 10 adhered to the intended inner side thereof which may be encased by folding the front section over the rear section (see FIG. 1*a*).

Figure 1B:
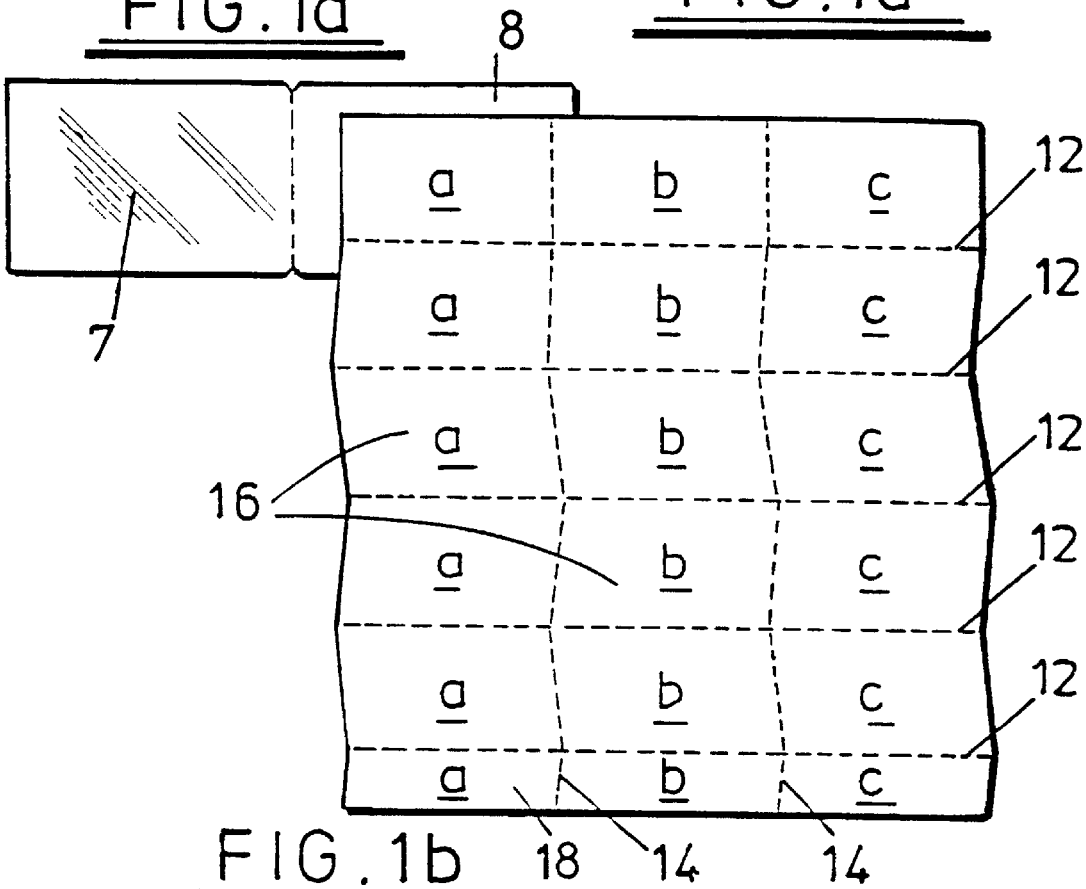
Figure 1C:
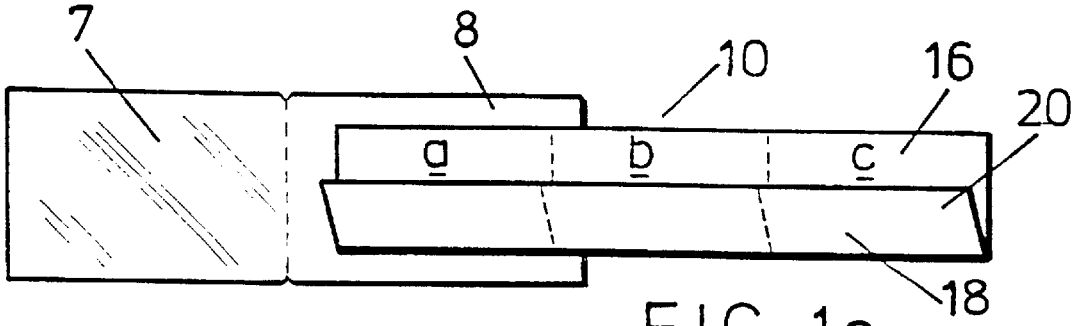

The sheet 10 is provided with a series of transverse and longitudinal crease lines, designated 12 and 14 respectively, which divide the sheet into fifteen regular sections 16 and three smaller sections 18 (see FIG. 1*b*). The longitudinal crease lines 14 define three transverse sections, designated a, b and c respectively. The sheet is folded into the fully folded state (FIG. 1*d*) by folding the sheet along the transverse creases such that adjacent longitudinal sections are brought into communication with each other (see FIG. 1*c*). The smaller sections 18 are also folded along the transverse crease line to bring the smaller section into communication with the adjacent longitudinal larger section 16 (see FIG. 1*c*) The outer section c may then be folded inwardly to cause the middle section b and outer section to lie over the inner section a (see FIG. 1*b*) thereby forming a compact folded sheet which may be contained within the cover 4.

The folded sheet may be opened out by carrying out the aforementioned steps in reverse order. The front section 7 of the cover 4 is pulled outwardly to expose the folded sheet 10. The comer of the outer small section 18*c* of the folded sheet provides a tab 20 for unfolding the sheet. The sheet is firstly pulled across to expose the first three larger sections (FIG. 1*c*) and then pulled downwardly to open out the whole sheet. The sheet may contain any useful information, such as advertising material, business details or a map, spreading over the entire surface thereof. Alternatively, the information may be divided into sections, for example, appearing on the front section of the fully folded sheet (FIG. 1*d*), across the partially folded sheet (FIG. 1*c*) and/or over the entire surface of the unfolded sheet (FIG. 1*b*). The folded sheet encased in the cover may be easily placed in a wallet or pocket for convenient use. The encased sheet may also be inserted into a protective sleeve, for example, of a plastics or cardboard material (not shown).

FIGS. 2*a* to 2*d* of the accompanying drawings illustrate an alternative embodiment of the present invention. The cover 30 again comprises a front section 32 and a rear section 34 separated by fold lines 36 but the rear section is also provided with a lip 38 along the leading edge thereof which is separated therefrom by fold lines 40. The lip is folded inwardly to lie over the rear section and the front section is folded inwardly to lie over the rear section and the lip.

An insert 42 is provided for placing within the cover. The insert has a generally rectangular section having a lip 44 at one end thereof and a tab 46 at the opposite end. The lip is separated from the rectangular section by a fold line 48. The intended inner side of the rectangular section has a folded sheet 10 adhered thereto, as described hereinbefore in relation to FIGS. 1*a* to 1*d*. The insert is placed within the cover 30 such that the lip 44 of the insert abuts the intended inner edge of the lip 38, as shown in FIGS. 2*c* and 2*d*. In this manner, the front and rear section of the cover may be held together to allow the insert to slide outwardly to expose the folded sheet 10 but preventing the insert from being completely removed from the cover due to the provision of the interlocking lips, thereby enabling the insert and folded sheet to be easily slid back inside the cover after use for storage purposes.

The cover 30 may,be contained within a sleeve (not shown), for example being made of a transparent plastics material or cardboard. This improves the efficiency of the device since the sleeve assists in maintaining the connection between the lip of the insert and lip of the cover thereby preventing the insert from being fully removed from the cover. Complete removal of the insert from the cover would result in the device being less convenient to use because it would be difficult to place the insert and the folded sheet back within the cover. It is to be appreciated that the front section of the cover may be provided with the lip for interlocking with the lip provided on the insert.

Yet a further embodiment of the present invention is illustrated in FIGS. 3*a* to 3*h* of the accompanying drawings. The cover 30' has a front section 32', a rear section 34' and a lip 38'. The lip is provided with an extension, in the form of a strip 68. The combined length of the lip and the strip is substantially equal to that of the front and rear sections. The insert 42' having the folded sheet 10 adhered thereto is provided with a slot 50 in the fold line 48' which separates the lip 44' from the rectangular section. The slot is dimensioned to allow the strip 68 of the cover to slide therethrough.

In operation, the insert may be pulled outwardly to expose the contents of the folded sheet but is prevented from becoming completely free of the cover by the provision of the retaining lip 38' and strip 68. The cover and insert are contained within a plastics sleeve 72 which is dimensioned to assist in retaining the lip of the insert within the cover and to prevent the insert being pulled free of the strip 68.

The strip may alternatively extend from the centre of the cover, the strip having a tab on its free end. The strip would pass through the slot in the insert to allow movement thereof over the length of the strip but would be retained thereon by the provision of the end tab.

It is to be appreciated that the cover and/or insert may be provided with more than one folded sheet, for example as shown in FIG. 4 where the insert 80 is provided with an additional flap 82 along one side thereof having a folded sheet 10 adhered thereto. The sheet should be composed of a paper which is sufficiently thin to be folded and inserted within the cover and/or sleeve but which retains fold lines to allow repeated folding and unfolding thereof. The internal resistance of the cover and insert is also important, the cardboard or plastics material of the insert and cover should be rigid but also have a degree of flexibility. The sleeve should also impart some resistance to prevent the cover and insert being easily removed therefrom. In this respect, the dimensions of the sleeve relative to the insert and cover are important to ensure that the lips thereof remain interlocked.

Additionally, the insert may be provided with a retaining edge along two or more sides thereof for mating with corresponding retaining edges provided on the rear section of the cover.

The cover and/or sleeve: provides means for holding onto the article whilst the insert is removed. Holding onto the cover/sleeve assists in preventing complete removal of the insert since the front and rear sections of the cover are pushed together thereby maintaining the connection between the lips of the cover and insert.

The cover and the insert may be supplied without the folded sheet, being provided with a double-sided adhesive for attachment of a folded sheet containing the required information. Alternatively, an insert may be supplied with a folded sheet attached thereto for replacement of an insert supplied with a cover and/or sleeve. Advertising or other information may also be displayed on the front and/or back of cover and/or the sleeve.

It is to be appreciated that the folded sheet may have more or less folds than the sheet hereinbefore described, the number of folds being defined by the number of longitudinal and transverse crease lines provided in the sheet.

FIGS. 5*a* to 5*d* of the accompanying drawings illustrate an alternative embodiment of a storage information device according to the present invention. The cover 100 is again comprised of a front section 101 and a rear section 103 separated by fold lines 105. The rear section is provided with two retaining lips 102 which are located on opposite sides of the rear section, at the free end thereof. An insert 104 corresponding to that described in FIGS. 2*b* and 2*c* is provided for placing between the front and rear sections of the cover, the insert having a lip 108 at one end thereof and a tab 106 at the other end.

The insert is placed inside the cover 100 and the cover is retained in a sleeve (not shown). The sleeve acts to push the front and rear sections of the cover onto the insert and also causes the lips 102 to be pressed against the insert. In this manner, the lips 102 act to prevent the complete removal of the insert from the cover and sleeve due to the lip 108 becoming interlocked with the retaining lips 102.

It is to be appreciated that the lips 102 may also be in the form of a continuous strip extending across the rear section from opposite sides thereof and that the retaining lips may be provided on the front section of the cover instead of the rear section.

An alternative mechanism for attaching a folded sheet to an insert for storage within a cover is illustrated in FIG. 6 of the accompanying drawings. A folded sheet 200 is provided (as hereinbefore described) which is attached, for example by means of an adhesive, to a folded card 202. This has a front section 202*a* to which the sheet is attached and a back section 202*b*. The back section is inserted into a wallet 204 consisting of two pieces of plastics material which are sealed together around all but one of their sides to allow insertion of the folded card. The wallet is then adhered to an insert 206 for placement in a cover and, optionally, a sleeve. This arrangement allows the card and sheet to be removed easily from the wallet and be replaced with a new folded card carrying a folded sheet which displays different information.

An alternative attachment mechanism for attaching a folded sheet to an insert for storage within a cover is illustrated in FIGS. 7*a* to 7*c* of the accompanying drawings. A folded sheet 210 (as hereinbefore described) is attached to a piece of card or plastics material 211 that is generally rectangular in plan view and has a tab 215 extending from one edge thereof. The insert 212 corresponds to that already described in relation to FIGS. 2*b* and 2*c*, having a lip 216 at one end and a tab 218 at the other end, but in addition is provided with a rectangular slot 220 and die-cut pocket 222 through the rectangular section thereof. The slot and die-cut product are positioned at spaced apart locations on the rectangular section such that the tab 215 of the material attached to the folded sheet may be inserted through the slot 220 and the leading edge of the material may be secured behind the flap formed by the die-cut pocket 222. This enables the folded sheet to be easily fixed to and removed from the insert 212.

A further embodiment of an information storage device according to the present invention is illustrated in FIGS. 8*a* to 8*e* of the accompanying drawings. A folded sheet 300 (see FIG. 8*a*) is attached to a piece of rectangular material 302 having an indented edge forming tabs 304, 306. This is then attached to an insert 308 having a lip 310, a slot 312 and a die-cut pocket 314, the tabs of the material 302 being held within the insert by the provision of the lip 310 of the insert and the leading edge of the material being slotted behind the tab formed by the die-cut pocket 314. A retaining strap 316 of material having a narrow section 316*a*, a wider middle section 316*b* and flange 316*c* is passed through the slot 312 in the insert and the insert, strap and folded sheet are passed through flaps 318 provided on opposing sides of the cover 320 (see FIG. 8*e*). The narrow section 316*a* of the retaining strap is then inserted through the slot 322 provided along the fold line of the front and rear section of the cover and is bent over to prevent the strap coming free from the slot. The whole assembly may then be inserted into a sleeve (not shown) to allow movement of the insert outwardly to expose the folded sheet but prevent the complete removal of the insert from the cover due to retaining strap 316.

Alternatively, the flaps 318 may extend along the entire length of the cover with the end of the strap being passed through a slot and back into the cover to provide an integral storage device that does not require a sleeve (not shown).

FIGS. 9*a* and 9*b* of the accompanying drawings show a further embodiment of an information storage device according to the present invention. A folded sheet 400 having information displayed thereon is again attached to a rectangular piece of material 410 having a tab 412 extending from one side thereof (as described in relation to FIG. 7*a*). This forms the first part of the information storage device. The second part is in the form of a cover 414 comprising a front section 414*a* and a rear section 414*b* separated by fold lines 415. A piece of material 416 is attached to the inner surface of the rear section 414*b* and has a slot 418 and die-cut pocket 420. These allow the first part of the storage device to be attached to the cover 414 by inserting the tab 412 into the slot 418 and placing the leading edge of the material 410 behind the tab formed by the die-cut pocket 420 (as indicated by the arrows in FIGS. 9*a* and 9*b*). In this manner, the first part may be removed from the second part and replaced with a new first part displaying different information thereon.

It is to be appreciated that the components of the information storage device may be made of any suitable material or mixture of materials. For example, the insert may be made of polyvinylchloride and the cover may be made of polypropylene to produce durable components for the device.

FIGS. 10*a* and 10*b* of the drawings show an alternative cover for receiving an information carrier. The cover 600 is formed of a rectangular piece of material having fold lines 602 separating the cover into a front section 600*a* and a rear section 600*b*. The rear section 600*b* is provided with a die-cut pocket 604 therethrough which is provided at a location such that the leading edge of the front section 600*a* may be inserted behind the tab formed by the die-cut pocket to close the cover (see FIG. 10*b*).

What is claimed is:

1. An information storage device comprising:

a first part on which information is stored; and a second part comprising a holder for the first part whereby the first part may be stored in said second part;

wherein the first part is in the form of an insert having a tab extending from an edge thereof and an edge opposite said tab, and the second part is provided with a slot therethrough and a die-cut pocket forming a tab, wherein said slot and said die-cut pocket are located on said second part at positions that correspond with a location of said tab of the insert and with said edge of said insert opposite said tab of said insert, respectively, wherein the insert is attachable to the second part by insertion of the tab of the insert into the slot and said opposing edge of said insert into said die-cut pocket, respectively.

2. An information storage device as claimed in claim 1, wherein the folded sheet is provided by a sheet having a plurality of transverse an longitudinal fold lines whereby the sheet may be folded and unfolded between a compact and expanded state, the folded sheet being dimensioned to fit within the second part in the compact state.

3. An information storage device as claimed in claim 2, wherein information is displayed on the insert.

4. An information storage device as claimed in claim 3, wherein a folded sheet is attached to the insert, the sheet having information displayed thereon.

5. An information storage device as claimed in claim 4, wherein the folded sheet is detachable from the insert.

6. An information storage device as claimed in claim 1, wherein the second part is in the form of a cover having a front section and a rear section separated by a centre fold line to provide a pocket for receiving said first part.

7. An information storage device as claimed in claim 6, wherein one of said front section and said rear section is provided with a die-cut pocket forming a tab for retaining a leading edge of the other section thereby effecting closure of the cover.

* * * * *